US011980232B2

(12) United States Patent
Zhao et al.

(10) Patent No.: US 11,980,232 B2
(45) Date of Patent: May 14, 2024

(54) CIGARETTE HEATING DEVICE

(71) Applicant: CHINA TOBACCO GUANGDONG INDUSTRIAL CO., LTD., Guangdong (CN)

(72) Inventors: Ruifeng Zhao, Guangdong (CN); Jing Hu, Guangdong (CN); Feng Li, Guangdong (CN); Guizhou Wu, Guangdong (CN); Yanjun Zhang, Guangdong (CN); Yibo Liu, Guangdong (CN); Rongfei Ye, Guangdong (CN)

(73) Assignee: CHINA TOBACCO GUANGDONG INDUSTRIAL CO., LTD., Guangdong (CN)

( * ) Notice: Subject to any disclaimer, the term of this patent is extended or adjusted under 35 U.S.C. 154(b) by 567 days.

(21) Appl. No.: 17/259,557

(22) PCT Filed: Jul. 12, 2019

(86) PCT No.: PCT/CN2019/095688
§ 371 (c)(1),
(2) Date: Jan. 12, 2021

(87) PCT Pub. No.: WO2020/258384
PCT Pub. Date: Dec. 30, 2020

(65) Prior Publication Data

US 2021/0321673 A1 Oct. 21, 2021

(30) Foreign Application Priority Data

Jun. 28, 2019 (CN) ..... 201910576952.0

(51) Int. Cl.
*A24F 40/485* (2020.01)
*A24F 13/08* (2006.01)
(Continued)

(52) U.S. Cl.
CPC ..... *A24F 40/485* (2020.01); *A24F 13/08* (2013.01); *A24F 13/22* (2013.01); *A24F 40/20* (2020.01); *A24F 40/46* (2020.01)

(58) Field of Classification Search
None
See application file for complete search history.

(56) References Cited

U.S. PATENT DOCUMENTS

2019/0183178 A1 6/2019 Chen et al.

FOREIGN PATENT DOCUMENTS

CN 204907924 U 12/2015
CN 107836751 3/2018
(Continued)

OTHER PUBLICATIONS

"International Search Report (Form PCT/ISA/210)" of PCT/CN2019/095688, mailed on Mar. 18, 2020, with English translation thereof, pp. 1-4.

(Continued)

*Primary Examiner* — Tho D Ta
(74) *Attorney, Agent, or Firm* — Gang Yu

(57) ABSTRACT

A cigarette heating device includes a cigarette holder, a heating cavity and a base which are connected in sequence. A top end of the heating cavity is communicated with the cigarette holder, the heating cavity is connected with a power supply device, and the power supply device is disposed at the base. The heating cavity includes a shell and a heating assembly for heating and baking a cigarette, the heating assembly is electrically connected with the power supply device, the shell surrounds an outer side of the heating assembly, and two ends of the shell are connected with the cigarette holder and the base, respectively. An air passage is disposed at a bottom end of the shell, and the heating cavity is communicated with an external environ- (Continued)

ment through the air passage for air to enter and exit the heating cavity.

9 Claims, 3 Drawing Sheets

(51) Int. Cl.
*A24F 13/22* (2006.01)
*A24F 40/20* (2020.01)
*A24F 40/46* (2020.01)

(56) References Cited

FOREIGN PATENT DOCUMENTS

| | | | | | |
|---|---|---|---|---|---|
| CN | 108634375 | A | | 10/2018 | |
| CN | 108634379 | A | | 10/2018 | |
| CN | 108887743 | | | 11/2018 | |
| CN | 208144423 | U | | 11/2018 | |
| CN | 208192148 | | | 12/2018 | |
| JP | 2018504134 | A | | 2/2018 | |
| WO | WO-2017211137 | A1 | * | 12/2017 | ..... A24F 40/40 |
| WO | 2018190606 | A1 | | 10/2018 | |
| WO | 2018190607 | A2 | | 10/2018 | |
| WO | 2018218397 | A1 | | 12/2018 | |

OTHER PUBLICATIONS

"Written Opinion of the International Searching Authority (Form PCT/ISA/237)" of PCT/CN2019/095688, mailed on Mar. 18, 2020, pp. 1-3.

* cited by examiner

CIGARETTE HEATING DEVICE

CROSS-REFERENCE TO RELATED APPLICATION

This application is a 371 of international application of PCT application serial no. PCT/CN2019/095688, filed on Jul. 12, 2019, which claims the priority benefit of China application no. 201910576952.0, filed on Jun. 28, 2019. The entirety of each of the above mentioned patent applications is hereby incorporated by reference herein and made a part of this specification.

BACKGROUND

Technical Field

The present invention relates to the field of electrical heating tobacco devices, and more particularly, to a cigarette heating device.

Description of Related Art

A traditional cigarette has a very high combustion temperature, which is about 900° C. Such high temperature may lead to pyrolysis to release many harmful ingredients. Generated smoke affects smokers themselves on one hand, and affects people around the smokers on the other hand, such as being harmful to health and causing unpleasant smell. Different from a traditional smoking way of intense combustion of lighting a cigarette with open flame, a smoking way of baking the cigarette with an incombustible heating device avoids a process of releasing the harmful ingredients by the pyrolysis since there is no open flame burning, and harmful substances generated in the smoke are much lower than those generated in a traditional cigarette after burning.

A cigarette heating device is an electronic device that heats and bakes the cigarette to volatilize aroma substances thereof, so as to obtain a feeling similar to smoking a combusted cigarette. Heating and baking of the cigarette require sufficient air. In an existing cigarette heating device, an air channel is mainly set by two ways. In a first way, air enters through a gap formed between the cigarette and a heating cavity, and the smoke is released by being sucked out through the cigarette. Sufficient air and smoke reserves cannot be ensured by this way, and looseness of the cigarette in the heating cavity affects a smoking quality. In a second way, the air channel is designed between an inner wall and an outer wall of the heating cavity, air supply enters a bottom portion of the cavity through a space between the inner wall and the outer wall close to a holder end, and then enters the cigarette through an end part of a cut tobacco. This way causes a long path and a complicated structure of the air channel, cannot achieve a good heat insulation effect, and is easy to cause cleaning troubles, resulting in poor user experience.

SUMMARY

In order to overcome the above defects in the prior art, the present invention provides a cigarette heating device, which allows air to enter and exit from a bottom end of a heating cavity of the cigarette heating device, has a short air channel path, can reserve sufficient air reserve and smoke reserves, and meanwhile, is further provided with an effective heat insulation structure for heat insulation of the cigarette heating device.

In order to solve the above technical problems, the present invention to adopts the following technical solutions.

A cigarette heating device includes a cigarette holder, a heating cavity and a base which are connected in sequence, a top end of the heating cavity is communicated with the cigarette holder, the heating cavity is connected with a power supply device, and the power supply device is disposed at the base. The heating cavity includes a shell and a heating assembly for heating and baking a cigarette, the heating assembly is electrically connected with the power supply device, the shell surrounds an outer side of the heating assembly, and two ends of the shell are connected with the cigarette holder and the base, respectively. An air passage is disposed at a bottom end of the shell, and the air passage communicates the heating cavity with an external environment for air to enter and exit the heating cavity.

When in use, the cigarette is extended into the heating cavity from a top part of the cigarette holder, the cigarette is heated and baked by the heating assembly, during heating, the air flows in from the air passage at the bottom end of the heating cavity, enters the heating assembly, and is supplied to the cigarette for heating, and finally, smoke is released by being sucked out through the cigarette.

Preferably, an air gap is disposed between the heating assembly and the shell, and a width of the air gap ranges from 0.5 mm to 1.5 mm. The air enters from the air passage at the bottom end of the heating cavity, passes through the air gap, and enters the heating assembly. In addition, the air gap achieves a heat insulation effect at the same time. Since the heating assembly has a high temperature during heating, leaving the air gap between the heating assembly and the shell reduces a contact area of solid heat transfer, implements air insulation of the heating assembly, and achieves a better heat insulation effect, so that a user does not feel too hot when touching, thus improving user experience.

Preferably, the heating assembly includes a heating body, a heating pedestal and a heat insulator, and the heating body is disposed on a top surface of the heating pedestal and is configured for being inserted into the cigarette for heating. The heat insulator is disposed on a periphery of the heating body and is capable of accommodating the cigarette, and the heat insulator is detachably connected with the heating pedestal. In particular, the heating pedestal and the heating body are main heating components, and the heat insulator is sleeved on the periphery of the heating body, wraps around the cigarette, and is connected and fixed with the shell.

Preferably, the shell has a hollow structure, and the shell is detachably connected with the heat insulator. Generally, the shell is connected with the heat insulator by a thread.

Preferably, the air passage includes a first air hole and a second air hole, and an air buffer cavity for buffering air reserve is disposed between the first air hole and the second air hole. A plurality of air passages are uniformly disposed at the bottom end of the shell, each air passage is divided into the first air hole and the second air hole, and the air buffer cavity is added between the two air holes, so that the air enters from the first air hole, passes through the air buffer cavity, and then enters the heating cavity from the second air hole. Disposing the air buffer cavity may be configured for buffering air in the heating cavity and air in the external environment to ensure sufficient air reserve, and moreover, the air buffer cavity strengthens an airflow vortex, and effectively blocks smoke leakage.

Preferably, the heat insulator is provided with a plurality of third air holes, and the third air holes are uniformly distributed around a periphery of the heat insulator, and communicate the air gap with an inner wall of the heat insulator at the same time. The air enters the air gap from the air passage, then flows into the heat insulator from the third air hole, and is supplied to the cigarette for heating and baking.

Preferably, the heat insulator is further provided with an expansion cavity for temporarily storing baked smoke, and the expansion cavity is annular, and is disposed around an outer wall of the cigarette. The cigarette may generate smoke for sucking after being baked and heated, and the expansion cavity is disposed at an outer wall of the cigarette, which may effectively store the smoke, thus ensuring stability of a taste under a condition of continuously sucking the smoke. Meanwhile, the expansion cavity expands a smoke mixing space, so that the smoke has a sufficient space for fully diffusing and mixing, thus improving the taste of the smoke sucked out.

Preferably, the base is provided with a hollow layer for heat insulation, the hollow layer is located between the heating cavity and the power supply device, and a height of the hollow layer ranges from 1.5 mm to 3 mm. The hollow layer is disposed between the heating cavity and the power supply device, which is mainly configured for reducing heat transfer from the heating cavity to the power supply device, thus avoiding the power supply device from being abnormal due to overheating. Connecting brackets are disposed around a periphery of the hollow layer, a middle part is hollowed, and the air is configured for heat insulation. Specifically, a pipeline is also disposed in the hollow layer for connecting the heating cavity with the power supply device. Generally, the power supply device includes a rechargeable battery, a power adapter and a charging interface which are connected in series, and the charging interface is a micro USB interface. The charging interface may be disposed on a bottom surface or a side surface of the base.

Preferably, a size of the first air hole is not equal to a size of the second air hole. Horizontal heights of the first air hole and the second air hole may be different.

As another solution, the size of the first air hole is equal to the a size of the second air hole, and the first air hole and the second air hole are located on a same horizontal line.

Compared with the prior art, the present invention has the beneficial effects as follows. 1) The air enters from the bottom end of the heating cavity, an air flowing path is short, and the air is sufficiently supplied. 2) The air buffer cavity is provided, which effectively buffers the air in the heating cavity and the air in the external environment, thus ensuring sufficient air reserve, and blocking smoke leakage at the same time. 3) The air gap is disposed between the heating assembly and the shell, which allows an air flow to pass through on one hand, and uses the air for heat insulation on the other hand, and the air gap reduces the contact area of the solid heat transfer, effectively blocks heat of a heating element, and reduces an external temperature of the device, so that the user does not feel too hot when touching, thus improving user experience. 4) The hollow layer is disposed between the heating cavity and the power supply device, which reduces the heat transfer from the heating cavity to the power supply device, thus avoiding the power supply device from being abnormal due to overheating. 5) The expansion cavity is provided, which expands the smoke mixing space, so that a sufficient space is provided for fully diffusing and mixing the smoke, and the smoke is effectively stored, thus ensuring the stability of the taste under the condition of continuously sucking the smoke.

DESCRIPTION OF THE EMBODIMENTS

Figure 1:
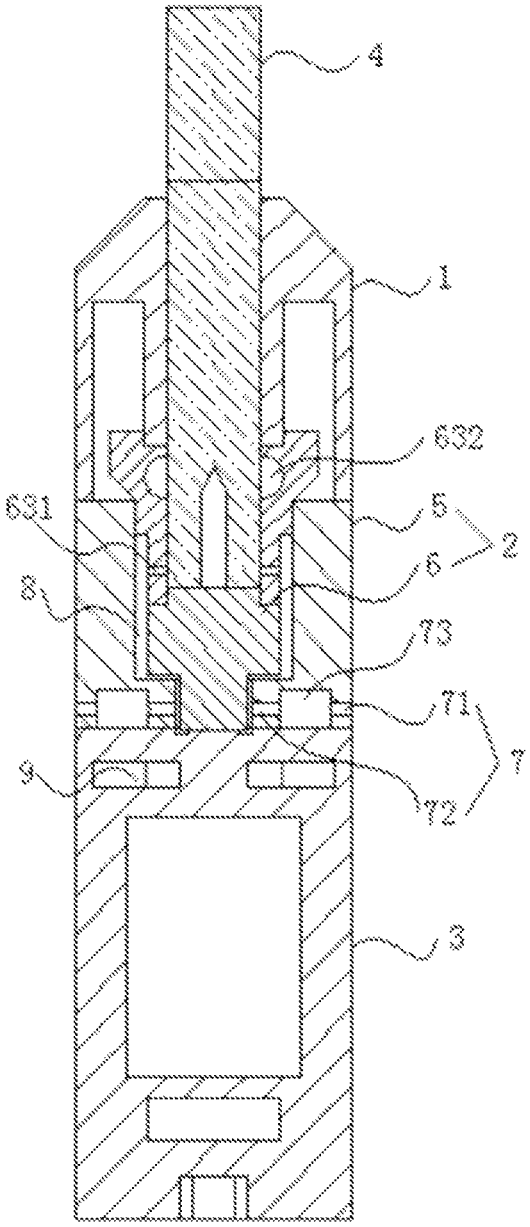
FIG. 1 is a structure sectional view of Embodiment 1.

The drawings are only for illustrative purposes, and cannot be understood as limiting the patent. In order to better illustrate the embodiments, some parts in the drawings may be omitted, enlarged or reduced, and do not represent actual sizes of products. For those skilled in the art, it is understandable that some well-known structures in the drawings and the descriptions may be omitted. The positional relationship described in the drawings is only for illustrative purposes, and cannot be understood as limiting the patent.

Embodiment 1

Figure 2:
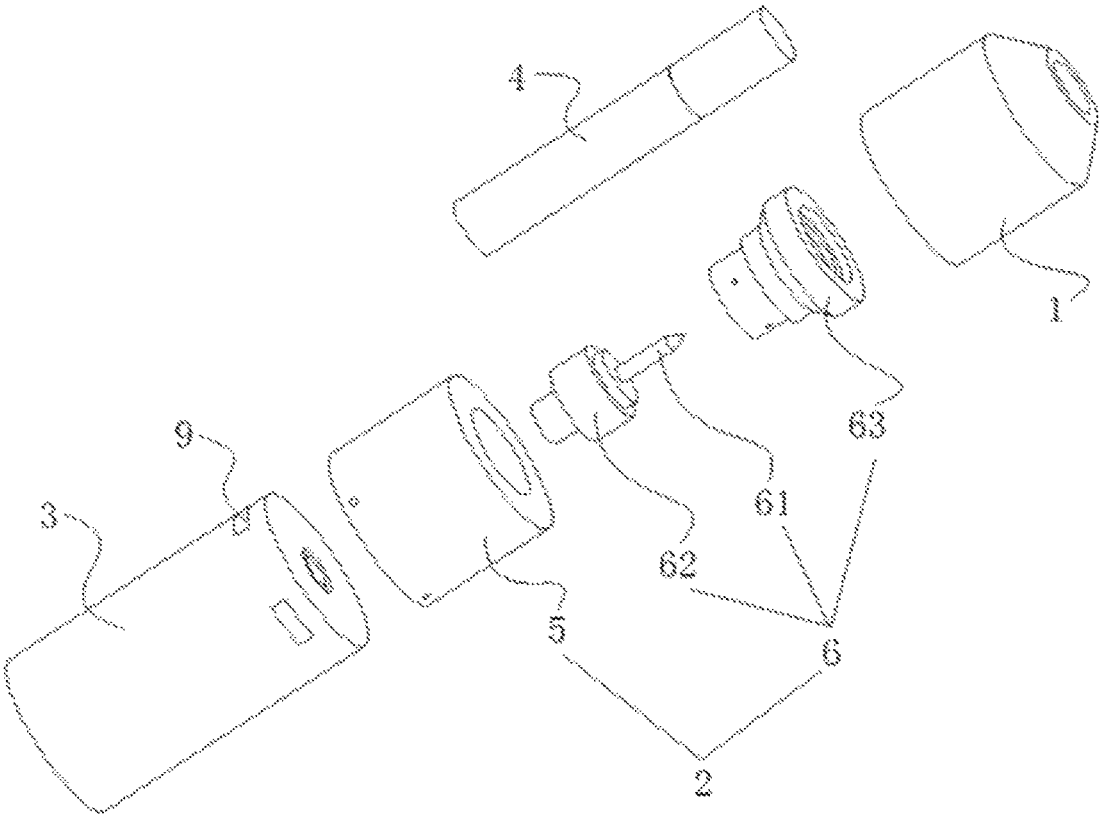
FIG. 2 is a structure exploded view of the present invention.

As shown in FIG. 1 to FIG. 2, this embodiment provides a cigarette heating device, which includes a cigarette holder 1, a heating cavity 2 and a base 3 which are connected in sequence. A top end of the heating cavity 2 is communicated with the cigarette holder 1, the heating cavity 2 is connected with a power supply device, and the power supply device is disposed at the base 3. Specifically, the power supply device includes a rechargeable battery, a power adapter and a charging interface which are connected in series, the charging interface is a micro USB interface, and the charging interface may be disposed on a bottom surface of the base 3.

The heating cavity 2 includes a shell 5 and a heating assembly 6 for heating and baking a cigarette 4, and the heating assembly 6 is electrically connected with the power supply device.

Figure 4:
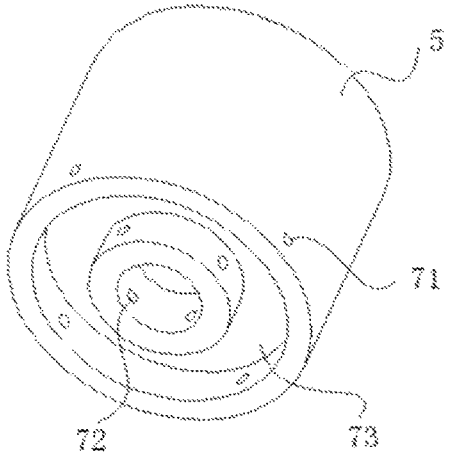
FIG. 4 is a schematic structure view of a shell.

Specifically, as shown in FIG. 4, the shell 5 has a hollow structure, which is disposed around an outer side of the heating assembly 6, an air gap 8 of 1 mm is disposed between the shell 5 and the heating assembly 6, and two ends of the shell 5 are connected with the cigarette holder 1 and the base 3, respectively. Meanwhile, a plurality of air passages 7 are disposed at the bottom end of the shell 5. In this embodiment, the air passage 7 is divided into a first air hole 71 and a second air hole 72. Further, a size of the first air hole 71 is equal to a size of the second air hole 72, and the first air hole and the second air hole are located on a same horizontal line. Moreover, an air buffer cavity 73 for buffering air reserve is also disposed between the first air hole 71 and the second air hole 72.

Figure 3:
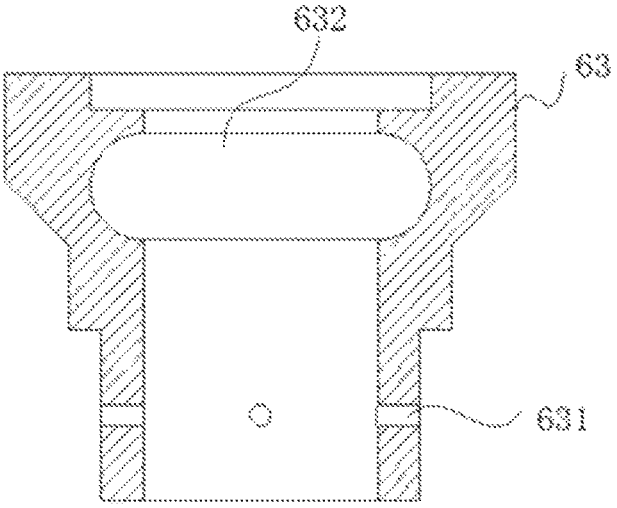
FIG. 3 is a structure sectional view of a heat insulator.

In addition, the heating assembly 6 includes a heating body 61, a heating pedestal 62 and a heat insulator 63. The heating body 61 is disposed on a top surface of the heating pedestal 62 and is used for being inserted into the cigarette 4 for heating. The heat insulator 63 is disposed on a periphery of the heating body 61 and is capable of accommodating the cigarette 4, and the heat insulator 62 is detachably connected with the heating pedestal 62. Meanwhile, the heat insulator 63 is connected and fixed with the shell 5 by a thread. Specifically, as shown in FIG. 3, the heat insulator 63 is provided with a plurality of third air holes 631, and the third air holes 631 are uniformly distributed around a periphery of the heat insulator 63, and communicate the air gap 8 with an inner wall of the heat insulator 63 at the same time. The air enters from the first air hole 71, passes through the air buffer cavity 73, then enters the air gap 8 from the second air hole 72, and finally enters the heat insulator 63 from the third air hole 631, and the air is supplied to the cigarette 4 for heating and baking.

Further, the heat insulator 63 is further provided with an expansion cavity 632 for temporarily storing baking smoke, and the expansion cavity 632 is annular, and is disposed around an outer wall of the cigarette 4. When the cigarette 4 is heated and baked to generate the smoke, the expansion cavity 632 expands a smoke mixing space, so that the smoke has a sufficient space for fully diffusing and mixing. Meanwhile, the smoke is effectively stored, and a stability of a taste is ensured under a condition of continuously sucking the smoke.

Further, the base 3 is provided with a hollow layer 9 for heat insulation, the hollow layer 9 is located between the heating cavity 2 and the power supply device, and a height of the hollow layer is 2 mm in this embodiment. Specifically, connecting brackets are disposed around a periphery of the hollow layer 9, a middle part is hollowed, and the air is used for heat insulation. Moreover, a pipeline is also disposed in the hollow layer for connecting the heating cavity 6 with the power supply device. The hollow layer 9 is disposed between the heating cavity 2 and the power supply device, which is mainly used for reducing heat transfer from the heating cavity 2 to the power supply device, thus avoiding the power supply device from being abnormal due to overheating.

A specific implementation manner of this embodiment is as follows. When in use, the cigarette 4 is extended into the heat insulator 63 of the heating cavity 2 from a top part of the cigarette holder 1, and abuts against a top surface of the heating pedestal 62, and the heating body 61 is inserted into the cigarette 4. The cigarette heating device is started up, the air enters from the first air hole 71 at the bottom end of the shell 5, passes through the air buffer cavity 73, then enters the air gap 8 in the heating cavity 2 from the second air hole 72, and finally enters the heat insulator 63 from the third air hole 631 at a side wall of the heat insulator 63, and the air is supplied to the cigarette 4 for heating and baking. The cigarette 4 generates the smoke after heated and baked, and a part of smoke is stored in the expansion cavity 632, so that the smoke has a sufficient space for fully diffusing and mixing, and the stability of the taste is ensured under the condition of continuously sucking the smoke. The air buffer cavity 73 buffers air in the heating cavity 2 and air in the external environment to ensure sufficient air reserve. Moreover, the air buffer cavity strengthens an airflow vortex, and effectively blocks leakage caused by reverse flow of the smoke. In addition, heat insulation is strengthened by disposing the air gap 8 and the hollow layer 9, so that the user does not feel too hot when touching. Meanwhile, heat transfer from the heating cavity 2 to the power supply device is reduced, thus avoiding the power supply device from being abnormal due to overheating.

Embodiment 2

Figure 5:
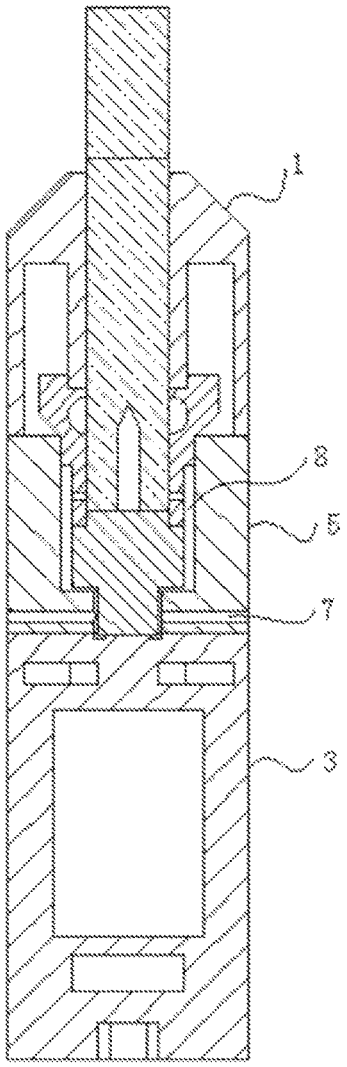
FIG. 5 is a structure sectional view of Embodiment 2.

As shown in FIG. 5, this embodiment also provides a cigarette heating device, which has a structure and a principle similar to that in the Embodiment 1, except that in this embodiment, a plurality of air passages 7 are disposed at the bottom end of the shell 5 of the heating cavity 2, and the air passages 7 are directly communicated with the air gap 8 in the heating cavity 2 and the external environment for the air to enter and exit the heating cavity 2.

Obviously, the above-mentioned embodiments of the present invention are merely examples for clearly illustrating the present invention, but are not intended to limit the implementations of the present invention. For those of ordinary skills in the art, other different forms of changes or variations can be made on the basis of the above description. It is not necessary or possible to exhaust all the implementations here. Any modifications, equivalent substitutions, and improvements made within the spirit and principle of the present invention shall all fall within the scope of protection claimed by the present invention.

What is claimed is:

1. A cigarette heating device, comprising a cigarette holder, a heating cavity and a base which are connected in sequence, wherein a top end of the heating cavity is communicated with the cigarette holder, the heating cavity is connected with a power supply device, and the power supply device is disposed at the base, the heating cavity comprises a shell and a heating assembly for heating and baking a cigarette, the heating assembly is electrically connected with the power supply device, the shell surrounds an outer side of the heating assembly, and two ends of the shell are connected with the cigarette holder and the base, respectively; and an air passage is disposed at a bottom end of the shell, and the air passage communicates the heating cavity with an external environment for air to enter and exit the heating cavity;

wherein the heating assembly comprises a heating body, a heating pedestal and a heat insulator, the heating body is disposed on a top surface of the heating pedestal and is configured for being inserted into the cigarette for heating; and the heat insulator is disposed at a periphery of the heating body and is capable of accommodating the cigarette, and the heat insulator is detachably connected with the heating pedestal.

2. The cigarette heating device according to claim 1, wherein the base is provided with a hollow layer for heat insulation, the hollow layer is located between the heating cavity and the power supply device, and a height of the hollow layer ranges from 1.5 mm to 3 mm.

3. The cigarette heating device according to claim 1, wherein an air gap is disposed between the heating assembly and the shell, and a width of the air gap ranges from 0.5 mm to 1.5 mm.

4. The cigarette heating device according to claim 3, wherein the heat insulator is further provided with an expansion cavity for temporarily storing baking smoke, and the expansion cavity is annular, and is disposed around an outer wall of the cigarette.

5. The cigarette heating device according to claim 3, wherein the shell has a hollow structure, and the shell is detachably connected with the heat insulator.

6. The cigarette heating device according to claim 5, wherein the air passage comprises a first air hole and a second air hole, and an air buffer cavity for buffering air reserves is disposed between the first air hole and the second air hole.

7. The cigarette heating device according to claim 6, wherein the heat insulator is provided with a plurality of third air holes, and the third air holes are uniformly distributed around a periphery of the heat insulator, and communicate the air gap with an inner wall of the heat insulator at the same time.

8. The cigarette heating device according to claim 6, wherein a size of the first air hole is not equal to a size of the second air hole.

9. The cigarette heating device according to claim 6, wherein a size of the first air hole is equal to a size of the second air hole, and the first air hole and the second air hole are located on a same horizontal line.

* * * * *